US005975630A

United States Patent [19]

Schreiber

[11] Patent Number: 5,975,630

[45] Date of Patent: Nov. 2, 1999

[54] SUN TRACKING LOUNGE CHAIR

[76] Inventor: Diana M. Schreiber, P.O. Box 91, Gray Summit, Mo. 63039

[21] Appl. No.: 09/177,748

[22] Filed: Oct. 23, 1998

[51] Int. Cl.[6] ..... A47C 7/62

[52] U.S. Cl. ..... 297/217.3; 297/344.23; 5/656; 607/95

[58] Field of Search ..... 297/217.1, 217.3, 297/344.21, 344.23; 5/656; 607/95

[56] References Cited

U.S. PATENT DOCUMENTS 4,140,128 2/1979 Van Der Schaaf .
4,379,588 4/1983 Speice .
4,441,220 4/1984 Peterson .
4,597,119 7/1986 Padgett .
4,856,520 8/1989 Bilicki .
4,933,618 6/1990 Ortlieb ..... 297/217.3
5,211,172 5/1993 McGuane et al. .

*Primary Examiner*—Anthony D. Barfield
*Attorney, Agent, or Firm*—Henderson & Sturm

[57] ABSTRACT

A lounge chair having a sun tracking positioning mechanism including at least one photo transistor having a lens for focusing sunlight in a straight line path passing through the lens and comprising a motor control circuit that allows a motor to operate for periods of no more than 30 seconds. Should the motor operate for a 30 second period, the system will deactivate. This 30 second cutout allows for controlling of shade times such as when the sun is behind clouds or the like.

7 Claims, 2 Drawing Sheets

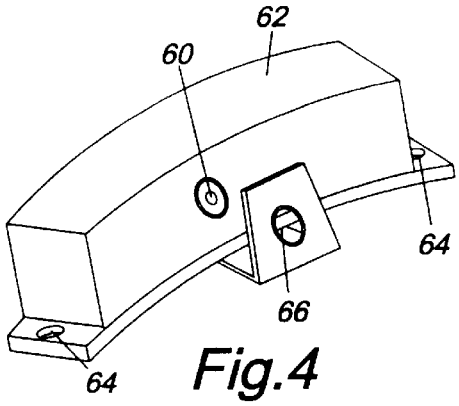
Fig.4
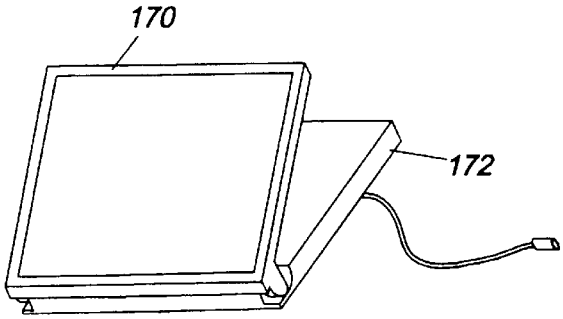
Fig.5
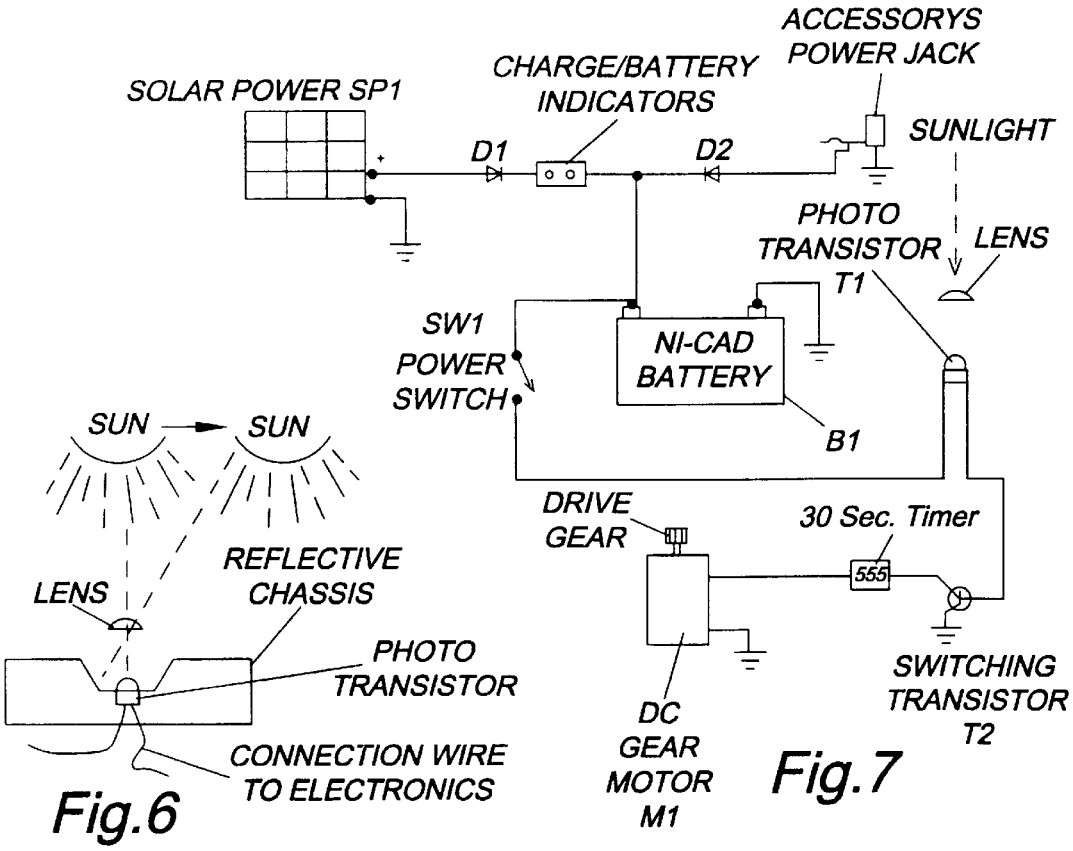
Fig.6
Fig.7

SUN TRACKING LOUNGE CHAIR

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of outdoor lounge chairs, and more particularly to an outdoor lounge chair that tracks the direction of the sun.

2. Description of Related Art

As can be seen by reference to the following U.S. Pat. Nos. 4,379,588; 4,140,128; 4,441,:220; 4,597,119; 4,856,520; and 5,211,172, the prior art is replete with myriad and diverse outdoor lounge chairs and suntanning devices.

While all of the aforementioned prior art constructions are more than adequate for the basic purpose and function for which they have been specifically designed, they are uniformly deficient with respect to their failure to provide a simple, efficient, and practical sun tracking lounge chair.

As a consequence of the foregoing situation, there has existed a longstanding need for a new and improved sun tracking lounge chair and the provision of such a construction is a stated objective of the present invention.

BRIEF SUMMARY OF THE INVENTION

Briefly stated, the present invention provides a lounge chair having a sun tracking positioning mechanism including at least one photo transistor having a lens for focusing sunlight in a straight line path passing through the lens and comprising a motor control circuit that allows a motor to operate for periods of no more than 30 seconds. Should the motor operate for a 30 second period, the system will deactivate. This 30 second cutout allows for controlling of shade times such as when the sun is behind clouds or the like.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 4 is a perspective view of the photo transistor assembly;

FIG. 5 is a perspective view of the accessory solar panel;

FIG. 6 is a schematic illustrating the photo transistor operation; and

FIG. 7 is an electrical schematic of the sun tracking lounge chair.

DETAILED DESCRIPTION OF THE INVENTION

Figure 1:
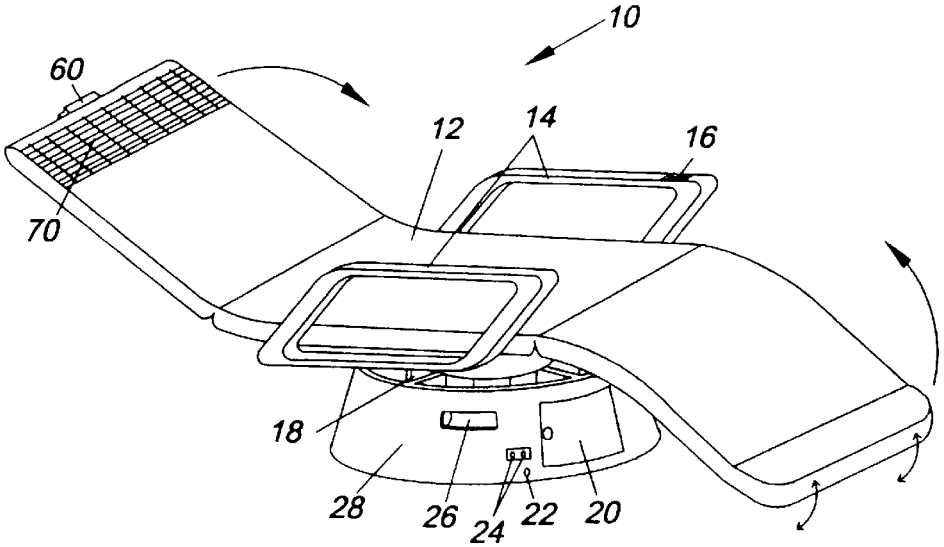
FIG. 1 is a perspective view of the sun tracking lounge chair of the present invention.

As can be seen by reference to the drawings, and in particularly to FIG. 1, the sun tracking lounge chair that forms the basis of the present invention is designated generally by the reference number 10. The chair 10 includes a cushioned lounger component 12, arm rests 14, a power switch 16, electrical drive components 18, a battery access door 20, an accessory power jack 22, charge battery indicators 24, carrying handles 26, a base 28, a key lock 30, the photo transistor assembly 60, and the solar collector array 70.

Figure 2:
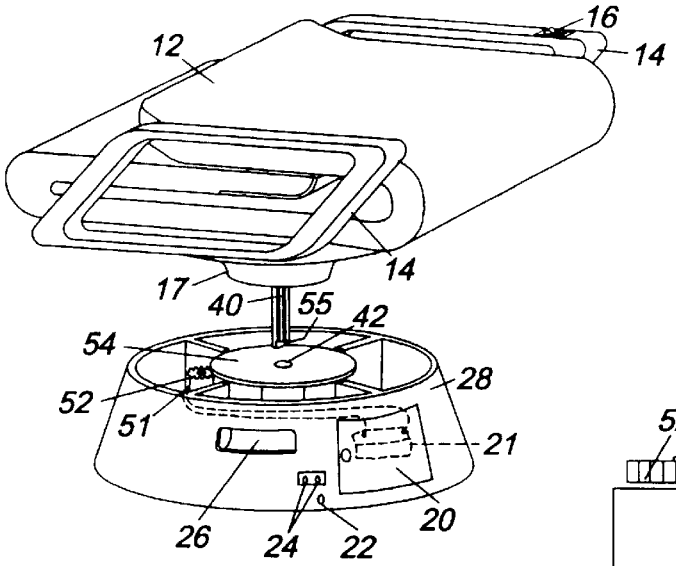
FIG. 2 is a perspective view similar to FIG. 1, but showing the chair portion folded to the storage position.

FIG. 2 further illustrates in detail, the technical relationship of the base frame folded lounger 12, and the power switch 16, the arm rests 14, the attachment base 17, the lounger attachment male shaft 40, the female hex chair attachment 42, the base 28, the battery access door 20, the Ni-Cad battery 21, the charge battery indicators 24, the carrying handles 26, the DC gear motor 51 with drive gear 52, the secondary drive gear 54, and the electrical contacts from chair wiring 55.

Figure 3:
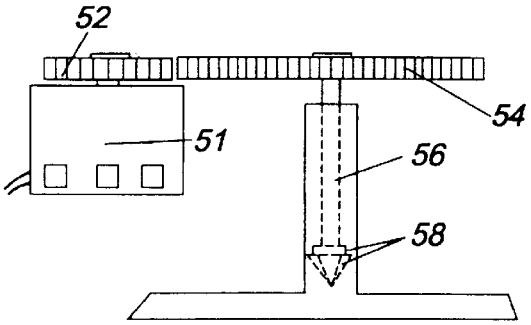
FIG. 3 is a schematic view of the electric motor drive.

FIG. 3 illustrates the DC gear motor 51 with drive gear 52, and the secondary drive gear 54, the female shaft bearing base 58, and the male shaft bearing with electrical slip rings 58.

FIG. 4 shows the photo transistor 60, the directional sun sensor chassis 62, the mounting holes 64, and the lens 66.

FIG. 5 illustrates the accessory solar panel 170 and the fold up base 172.

The design of the chair 10 is that of a lounge chair used for sunbathing which has the unique feature of automatically turning, tracking the sun as the sun's direction changes. The chair 10 not only tracks the sun, but also derives its power from the sun via a solar cell array 18 that attractively blends in with the lounge chair portion. The chair 10 enables those who are relaxing in the sun to remain in the chair, allowing the chair to turn facing the sun. This keeps the individual from getting up from the lounge chair to physically turn the chair each time the sun moves. Doing so provides the user with an even tan since many times sunbathers fall asleep while tanning, losing the sun.

The main framework or base of the chair 10 is manufactured of high impact ABS plastic and contains the majority of the components that allow the chair 10 to operate. The lounge chair component 12 is driven by means of a DC powered gear motor 51 through high impact nylon gears. A driving gear 52 located on the motor shaft is connected to a larger (4 to 1 gear ratio) nylon driven gear 54 that moves the lounge chair 10 very slowly. A pivot bearing provides an almost frictionless bearing surface to which the lounge chair is attached by means of a male/female hexagon shaft arrangement 40, 42 which allows the lounger component 12 to be easily removed from the base 28 if necessary.

Power to drive the DC gear motor 51 comes from a Ni-Cad rechargeable battery 21 that is kept in a charged condition by means of a solar collector array 70 located at the top portion of the lounge component 12. The battery 21 is located within a secure area inside the base 28 and is accessible through a key locked access door 20. A power on/off switch 16 is located on the armrest 14 of the lounger 12. While power from the sun is more than enough to power the motor 51, an accessory jack 22 located on the base portion 28 allows the user to plug in an AC power pack. This provides charging from a wall outlet for initial use, or quick charging due to lack of use during the winter. A secondary optional solar panel 170 may also be plugged in and placed in a remote location in case of inconvenient shadows that might interfere with the charging process at the top solar panel. A charge indicator 24 located on the side of the base 28 indicates the state of the charge condition of the Ni-Cad battery 21.

It is common knowledge that the sun moves or tracks across the sky from east to west. This means that the chair 10 and the motor powering it only have to move in one direction. To sense motion from the sun, the electronic sun tracking assembly includes a lens 66, photo/transistor 60, and a plastic housing 62. The electronic sun tracker assembly is located at the top of the lounge chair 12 above the solar collector 70. Referring to FIG. 4, and to the schematic drawing of FIGS. 6 and 7, it can be seen that the lens 66 is located in a path that is in direct alignment with the photo/transistor 60. The lens 66 portion of the assembly is aimed at the sun, focusing a small beam of sunlight onto the photo/transistor 60 when facing the sun. As long as general lighting conditions from the sun keep light focused onto the photo/transistor 60, the lounge component 12 will not move, thus keeping it facing the sun. When the sun tracks across the sky, the lens 66 will focus the sunlight beam away from the photo/transistor 60 onto a blank portion of the electronic sun tracker assembly. Whenever this occurs, the lack of sunlight on the photo/transistor 60 causes the photo/transistor 60 electronics to provide electricity from the Ni-Cad battery 21 to the DC gear motor 51, causing the lounge chair portion 12 to slowly and gently move toward the direction of the sun. The chair portion 12 will keep moving until the lens 66 of the electronic sun tracker is again in alignment with the sun, shining a small beam of sunlight onto the photo/transistor 60. Once the photo/transistor 60 again has light upon its surface coming from the sun, the photo/transistor 60 switches, removing voltage from the DC drive gear motor 51, stopping the chair portion 12 in a position facing the sun. This automated sequence continues, allowing the chair portion 12 to track and face the sun.

The movement of the chair portion 12 is in most cases undetectable as is the motion of the sun, moving very slowly. A timer within the circuit (FIG. 7) keeps the motor 51 running for only 30 seconds. Under normal circumstances, the motor 51 would only run for approximately 5 seconds at a time in order to track the sun. The timer shuts off the motor 51 after 30 seconds in case a cloud or other obstruction of sunlight should occur. This keeps the chair portion 12 from constantly turning around in a circle if a lack of directional sunlight should occur. The chair 10 may be reactivated by means of pushing the spring loaded rocker switch 16 to the on position, allowing the chair portion 12 to find and face the sun, tracking it in the previously described manner.

Wiring that connects the electrical/electronic components of the lounge chair to the electrical components in the base does so by means of electrical slip rings. This allows electrical connection between the moving lounge chair 12 and the base 28 without the wires tangling as the lounge chair 12 turns around.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A sun tracking lounge chair, consisting of:

a base;

an electric motor drive mounted on the base;

a chair portion rotatably mounted on the base, and being operably attached to the motor drive;

a main solar electric power array electrically coupled to the motor drive by a circuit;

the circuit including a photo transistor switch operable to activate the motor drive for a minimum period of five seconds when not exposed to sunlight; and the circuit further including a timer operable to deactivate the motor drive after a predetermined activation period of thirty seconds.

2. The sun tracking lounge chair of claim 1 wherein the circuit further includes a battery operable to power the circuit when output from the solar array is at a predetermined low level.

3. The sun tracking lounge chair of claim 1 further including an accessory solar array electrically coupled to the circuit.

4. The sun tracking lounge chair of claim 1 wherein the main solar array is mounted on an upper section of the chair portion.

5. The sun tracking lounge chair of claim 1 wherein the base includes hand grips.

6. The sun tracking lounge chair of claim 1 wherein the chair portion is adapted to be foldable to a storage position.

7. The sun tracking lounge chair of claim 1 wherein the chair portion is adapted to be releasably attached to the base.

* * * * *